United States Patent [19]

Miller

[11] Patent Number: 4,608,151

[45] Date of Patent: Aug. 26, 1986

[54] PROCESS FOR PRODUCING HIGH QUALITY, HIGH MOLECULAR WEIGHT MICROCRYSTALLINE WAX DERIVED FROM UNDEWAXED BRIGHT STOCK

[75] Inventor: Stephen J. Miller, San Francisco, Calif.

[73] Assignee: Chevron Research Company, San Francisco, Calif.

[21] Appl. No.: 806,079

[22] Filed: Dec. 6, 1985

[51] Int. Cl.[4] ..... C10G 73/08; C10G 73/44

[52] U.S. Cl. ..... 208/33; 208/27; 208/37; 208/57; 208/58; 208/97; 208/254 H

[58] Field of Search ..... 208/57, 58, 95, 96, 208/97, 89, 254 H, 20, 27, 28, 33, 37

[56] References Cited

U.S. PATENT DOCUMENTS

| | | | |
|---|---|---|---|
| 3,052,622 | 9/1962 | Johnson et al. | 208/27 |
| 3,666,657 | 5/1972 | Thompson et al. | 208/97 |
| 3,755,138 | 8/1973 | Chen et al. | 208/28 |
| 3,779,894 | 2/1973 | Eagen et al. | 208/37 |
| 3,941,680 | 3/1976 | Bryson et al. | 208/18 |
| 4,139,494 | 2/1979 | Itoh et al. | 208/27 |
| 4,148,711 | 4/1979 | Holder | 208/20 |
| 4,186,078 | 1/1980 | Itoh et al. | 208/27 |
| 4,549,955 | 10/1985 | Shih | 208/89 |

*Primary Examiner*—Andrew H. Metz
*Assistant Examiner*—Anthony McFarlane
*Attorney, Agent, or Firm*—S. R. La Paglia; W. K. Turner

[57] ABSTRACT

A process for producing high quality, high molecular weight microcrystalline wax from a hydrocracked, undewaxed bright stock, comprising hydrodenitrification, mild hydrofinishing, and solvent dewaxing.

19 Claims, No Drawings

PROCESS FOR PRODUCING HIGH QUALITY, HIGH MOLECULAR WEIGHT MICROCRYSTALLINE WAX DERIVED FROM UNDEWAXED BRIGHT STOCK

BACKGROUND OF THE INVENTION

This invention relates to a process for producing high quality, high molecular weight microcrystalline wax from hydrocracked undewaxed bright stock. The process comprises three steps. In the first step, a hydrocracked undewaxed bright stock is hydrodenitrified using, for example, a sulfided nickel-tin or nickel-molybdenum hydrotreating catalyst having a siliceous or alumina matrix. In the second step, the bright stock, having a reduced catalyst poison content, is hydrofinished using, for example, an unsulfided nickel-tin or palladium hydrotreating catalyst having a siliceous or alumina matrix. In the third step, the waxy oil is solvent dewaxed using a conventional dewaxing solvent such as a mixture of methyl-ethyl-ketone (MEK) and toluene. It has been found that this three-step process produces a high quality, high molecular weight microcrystalline wax.

The first two steps are carried out at unusually low liquid hourly space velocity (LHSV), about 0.25 $hr^{-1}$. In the first step, a low LHSV permits the desired hydrodenitrification reaction to proceed at relatively low temperatures. Under these conditions, hydrocracking is minimized. In the second step, a low LHSV permits thorough saturation of aromatics. This sequence of steps provides for the recovery of high molecular weight microcrystalline wax in the third and final step, solvent dewaxing.

New markets continue to expand in demand for petroleum waxes. The varied and growing uses for the petroleum waxes have lifted this material from the by-product class to the product class in operations in some refineries. Waxes derived from petroleum are hydrocarbons of three types: paraffin, semi-microcrystalline, and microcrystalline. The quality and quantity of the wax separated from the crude oil depend on the source of the crude oil and the degree of refining to which it has been subjected prior to wax separation. Paraffin, semimicrocrystalline, and microcrystalline waxes may be differentiated using the refractive index of the wax and its congealing point as determined by ASTM D 938. In addition, petroleum waxes can be distinguished by their viscosities. For example, semi-microcrystalline wax has a kinetic viscosity at 98.9° C. of less than 10 $mm^2/s$ (=cSt), while microcrystalline wax has a kinetic viscosity at 98.9° C. of greater than or equal to 10 $mm^2/s$ (=cSt).

Microcrystalline wax, which contains substantial portions of hydrocarbons other than normal alkanes, is the most valuable of the petroleum waxes. It is used in the manufacture of many products such as food containers, waxed papers, coating materials, electrical insulators, candles, etc., and is usually obtained from the highest boiling fraction of a crude oil.

In the manufacture of conventional microcrystalline waxes, the bottoms stream from a vacuum tower or "bright stock" is deasphalted to produce a heavy deasphalted oil which is then extracted to partially remove aromatics. The term "microcrystalline wax" generally refers to deoiled (to less than about 5 wt % oil) wax having a melting point varying from about 140° F. to 180° F. which is recovered from this deasphalted, extracted oil by dewaxing and deoiling. The wax obtained by such a process is characterized by a poor odor, a dark color and it contains aromatic impurities as shown by ultraviolet absorption tests. Thus, the wax must be further refined in order to yield useful products. In the past, microcrystalline wax was contacted with solid absorbent materials such as bauxite or clay to absorb the aromatic compounds therefrom which impart unfavorable properties to the wax.

Accordingly, a process which produces a high quality microcrystalline wax, absent the undesirable properties of poor odor, dark color, and aromatic impurities would be advantageous. It is the principle object of this invention to provide such a process.

Various improvements in the refining of microcrystalline waxes have been made over the years. The most notable of these processes have been directed towards catalytic refining of the wax in the presence of hydrogen, also known as hydrofining. For example, U.S. Pat. No. 3,052,622 discloses taking a crude oil residua and simultaneously deasphalting and extracting the aromatics from it via the Duo-Sol process to obtain a waxy petroleum residue which is then hydrofined by passing the wax, in the presence of hydrogen, over a catalyst of nickel oxide on bauxite. The hydrofined product is then dewaxed via a conventional solvent dewaxing process using toluene and MEK as the dewaxing solvent.

None of these prior art processes have been found, however, to be completely satisfactory. To produce a refined wax that meets U.S. Food and Drug Administration (FDA) standards, the produced waxes must be further refined by contacting with a solid absorbent and then acid treated to achieve the necessary FDA color, odor, and color stability requirements. It is therefore a further objective of this invention to produce a wax that meets FDA standards for color, odor, and color stability, without being further refined by expensive and cumbersome solid desorption methods.

SUMMARY OF THE INVENTION

The discovery of the present invention is embodied in an improved process for preparing a high quality, high molecular weight microcrystalline wax, comprising:

(a) contacting a hydrocracked undewaxed bright stock feed with hydrogen in the presence of a catalyst having hydrodenitrification activity under conditions effective to reduce the nitrogen content of the stock to produce a substantially nitrogen-free product;

(b) contacting the product of step (a) with hydrogen in the presence of a catalyst having hydrogenation activity under mild conditions to produce a stabilized wax-containing oil; and (c) solvent dewaxing the product of step (b) to produce high molecular weight microcrystalline wax.

DETAILED DESCRIPTION OF THE INVENTION

The hydrocarbonaceous feeds from which the undewaxed bright stocks used in the process of this invention are obtained usually contain aromatic compounds as well as normal and branched paraffins of very long chain lengths. These feeds usually boil in the gas oil range. Preferred feedstocks are vacuum gas oils with normal boiling ranges above about 350° C. and below about 600° C., and deasphalted residual oils having normal boiling ranges above about 480° C. and below about 650° C. Reduced topped crude oils, shale oils, liquefied coal, coke distillates, flask or thermally cracked oils, atmospheric residua, and other heavy oils can also be used as the feed source.

Typically, the hydrocarbonaceous feed is distilled at atmospheric pressure to produce a reduced crude (residuum) which is then vacuum distilled to produce a distillate fraction and a resid fraction. According to the present process, the vacuum residuum fraction is then hydrocracked using standard reaction conditions and catalysts in one or more reaction zones.

In general, refineries process at least one distillate fraction and one residuum fraction to produce several base stocks. Typically, several distillate fractions and the residuum of a vacuum distillation operation are refined. These fractions have acquired various names in the refining art. In particular, the residuum fraction is commonly referred to as "bright stock".

In the first step of the present process, an undewaxed bright stock is hydrogenated to reduce its nitrogen level. Conventional hydrodenitrification catalysts and conditions can be used when carrying out this step. For the second step to achieve aromatic saturation of the hydrocracked bright stock, however, the first step must employ a combination of catalysts and hydrogenation conditions which will reduce the nitrogen level of the stock to below about 50 ppm by weight without substantially increasing the quantity of aromatic unsaturates by hydrocracking side reactions. In addition to the desired hydrodenitrification, such catalysts and conditions will inherently result in cleavage of carbon-sulfur bonds to form hydrogen sulfide. This results in some level of hydrodesulfurization. Organic sulfur is deleterious to the activity of the hydrofinishing step.

Typical hydrodenitrification catalysts suitable for use in this first step comprise a Group VIIIA metal, such as nickel or cobalt, and a Group VIA metal, such as molybdenum or tungsten (unless otherwise noted references to the Periodic Table of Elements are based upon the IUPAC notation) with a siliceous or alumina matrix. Such catalysts are well known in the art. U.S. Pat. No. 3,227,661, granted Jan. 4, 1966 to Jacobson et al., describes a method which may be used to prepare a suitable hydrodenitrification catalyst.

Typical hydrodenitrification conditions which are useful in the first step of the present process vary over a fairly wide range. In general, temperatures range from about 500° F. to about 850° F., preferably about 550° F. to 800° F.; pressures range from about 500 psig to about 4000 psig, preferably about 1000 psig to about 3000 psig, ideally about 1500 psig to about 2500 psig; contact times expressed as LHSV range from about 0.1 per hour to about 10 per hour, preferably about 0.1 per hour to about 0.8 per hour, ideally about 0.25 per hour; and hydrogen rates range from about 5000 cu. ft. per barrel to about 15,000 cu. ft. per barrel. U.S. Pat. No. 3,227,661 describes those conditions required for various processing schemes using the denitrification catalysts taught in that patent. A general discussion of hydrodenitrification is available in U.S. Pat. No. 3,073,221, granted on Feb. 19, 1963 to Beuther et al. As discussed, when selecting denitrification conditions from the general teachings of the art, the main concern is the use of relatively low LHSV and temperature to achieve nearly complete denitrification with minimal hydrocracking.

In the second step of the present process, the denitrified, "clean" stock is hydrofinished using a hydrogenation catalyst and mild conditions. Suitable catalysts can be selected from conventional hydrofinishing catalysts having hydrogenation activity. For example, a noble metal from Group VIIIA, such as palladium, on a refractory oxide support or unsulfided Group VIIIA and Group VI, such as nickel-molybdenum, or nickel-tin, is a suitable catalyst. U.S. Pat. No. 3,852,207, granted on Dec. 3, 1974 to Stangeland et al., describes a suitable noble metal catalyst and mild conditions.

As noted, suitable hydrofinishing conditions should be selected to achieve as complete a hydrogenation of unsaturated aromatics as possible. Because the first step has removed the common hydrogenation catalyst poisons, the second step run length can be relatively long affording the opportunity to use a relatively low LHSV and mild conditions. Suitable conditions include a temperature ranging from about 300° F. to about 600° F., preferably from about 350° F. to about 550° F.; a pressure ranging from about 500 psig to about 4000 psig, preferably from about 1500 psig to about 3000 psig, ideally about 1500 psig to about 2500 psig; and an LHSV ranging from about 0.1 to about 2.0 per hour, preferably from about 0.1 per hour to about 0.5 per hour, ideally about 0.25 per hour. Thus, in general terms the clear hydrodenitrified effluent of the first step is contacted with hydrogen in the presence of a hydrogenation catalyst under mild hydrogenation conditions. Other suitable catalysts are detailed, for example, in U.S. Pat. No. 4,157,294 granted June 5, 1979 to Iwao et al. and U.S. Pat. No. 3,904,513 granted Sept. 9, 1975 to Fischer et al., both incorporated herein by reference.

In the third step, the wax-containing hydrocarbon oil is dewaxed using conventional dewaxing procedures and apparatus. The wax-containing oil can be chilled in the presence or absence of a dewaxing solvent to a temperature low enough to crystallize the hard wax. Preferably, however, this first chilling to crystallize the hard wax is performed using a dewaxing solvent, such as a mixture of MEK and toluene. For example, the wax-containing oil can be dewaxed by total predilution using scraped surface chiller apparatus in which the wax-containing hydrocarbon oil, with or without prior heating but preferably with prior heating to insure dissolution of all the wax present therein, is mixed with a quantity of dewaxing solvent to give a dilution of about 1/1 to 10/1 solvent to wax-containing oil. This solvent/oil mixture is then fed to a scraped surface chiller wherein the mixture is chilled to a wax separation temperature via indirect chilling. This chilling in the present invention is to a temperature sufficient to crystallize the high melting point hard waxes and is typically to about −10° F. to 100° F., preferably about −10° F. to 60° F., ideally about −10° F. to 30° F. Other suitable dewaxing processes are detailed, for example, in U.S. Pat. No. 4,461,697 granted July 24, 1985 to West and U.S. Pat. No. 4,356,080 granted Oct. 26, 1982 to Pullen et al., both incorporated herein by reference.

The present invention is exemplified below. The example is intended to illustrate a representative embodiment of the invention and results which have been obtained in laboratory analysis. Those familiar with the art will appreciate that other embodiments of the invention will provide equivalent results without departing from the essential features of the invention.

EXAMPLE

A waxy hydrocracked bright stock (Table I) was hydrofinished in the first stage of a two-stage hydrofinisher over a pre-sulfided proprietary cogelled Ni—Sn—$SiO_2$—$Al_2O_3$ catalyst comprising 9.6 wt % Ni and 3.4 wt % Sn at 570° F., 2000 psig, 0.25 LHSV, and 8 M SCF/bbl $H_2$. The product was subsequently hydrofinished in the second stage over an unsulfided charge of the above Ni—Sn catalyst at 430° F., 2200 psig, 0.5 LHSV, and 8 M SCF/bbl $H_2$.

The waxy product from the second stage was solvent dewaxed using 60/40 mixture of methyl-ethyl-ketone (MEK) and toluene at a 3/1 solvent/oil ratio and a crystallization and filtration temperature of −5° F. The slack wax was then deoiled with 80/20 MEK/toluene at 50° F.

Properties of the microcrystalline wax are listed in Table II. The ASTM color is well within the range for commercial microwaxes of <0.5 to 2.0.

To test whether the wax was acceptable for food contact, it was checked for absorbance to compare with U.S. Food and Drug Administration (FDA) specifications. Table III shows that the microwax passes the FDA test without need for further processing.

TABLE I

| Hydrocracked Bright Stock Inspections | |
|---|---|
| Gravity | 26.1 |
| Sulfur, ppm | 84 |
| Nitrogen, ppm | 112 |
| Pour Point, °F. | >80° F. |
| Viscosity, cSt, 100° C. | 26.49 |
| Distillation, D1160 LV %, °F. | |
| ST/5 | 970/992 |
| 10 | 1009 |

TABLE II

| Wax Properties | |
|---|---|
| Deoiling Temperature, °F. | 50 |
| Yield from Waxy Oil, % | 8 |
| Melting Point, °F. AMP (Mod. ASTM D 87) | 166 |
| Refractive Index at 80° C. | 1.4530 |
| ASTM Color (ASTM D 1500) | 0.5 |

TABLE III

| | Wax Absorbance | |
|---|---|---|
| Wavelength, nm | Microwax | FDA Specification (Max) |
| 280–289 | 0.13 | 0.15 |
| 290–299 | 0.10 | 0.12 |
| 300–359 | 0.08 | 0.08 |
| 360–400 | 0.02 | 0.02 |

What is claimed is:

1. A process for preparing high molecular weight microcrystalline wax from a hydrocracked, undewaxed bright stock, comprising:

(a) contacting said bright stock with hydrogen in the presence of a catalyst having hydrodenitrification activity under conditions effective to reduce the nitrogen content of said stock to produce a substantially nitrogen-free product;

(b) contacting said substantially nitrogen-free product with hydrogen in the presence of a catalyst having hydrogenation activity under mild conditions to produce a wax-containing oil; and (c) solvent dewaxing said wax-containing oil to produce high molecular weight microcrystalline wax.

2. A process according to claim 1 wherein said solvent dewaxing step comprises:

(a) chilling said wax-containing oil;

(b) contacting said chilled wax-containing oil with a dewaxing solvent to produce a solvent/oil mixture; and (c) chilling said solvent/oil mixture to a temperature sufficient to crystallize high melting point hard waxes contained therein.

3. A process according to claim 2 wherein the ratio of said dewaxing solvent to said wax-containing oil ranges from about 1.0 to 1.0 to about 10.0 to 1.0.

4. A process according to claim 2 wherein said dewaxing solvent comprises a mixture of methyl-ethyl-ketone and toluene.

5. A process according to claim 2 wherein said temperature, sufficient to crystallize said waxes, ranges from about −10° F. to about 100° F.

6. A process according to claim 2 wherein said temperature, sufficient to crystallize said waxes, ranges from about −10° F. to about 60° F.

7. A process according to claim 2 wherein said temperature, sufficient to crystallize said waxes, ranges from about −10° F. to about 30° F.

8. A process according to claim 1 wherein the catalyst having hydrodenitrification activity comprises at least one metal from Group VIIIA and at least one metal from Group VIA or tin supported on an alumina or siliceous matrix.

9. A process according to claim 8 wherein said Group VIIIA metal is nickel or cobalt and said Group VIA metal is molybdenum or tungsten.

10. A process according to claim 9 wherein said catalyst is sulfided.

11. A process according to claim 1 wherein said hydrodenitrification is carried out at a temperature ranging from about 600° F. to about 850° F., a pressure ranging from about 500 psig to about 4000 psig, an LHSV ranging from about 0.1 $hr.^{-1}$ to about 3 $hr.^{-1}$, and a substantial hydrogen partial pressure.

12. A process according to claim 11 wherein said LHSV is from about 0.1 $hr.^{-1}$ to about 0.8 $hr.^{-1}$.

13. A process according to claim 12 wherein said LHSV is about 0.25 $hr.^{-1}$.

14. A process according to claim 1 wherein said catalyst having hydrogenation activity comprises at least one Group VIIIA noble metal supported on a refractory oxide.

15. A process according to claim 14 wherein said noble metal is palladium.

16. A process according to claim 1 wherein said hydrogenation of the substantially nitrogen free product is carried out at a temperature ranging from about 300° F. to about 600° F. and is below the temperature at which the hydrodenitrification is carried out, a pressure ranging from about 500 psig to about 4000 psig, and an LHSV ranging from about 0.1 $hr.^{-1}$ to about 2 $hr.^{-1}$ and a substantial hydrogen partial pressure.

17. A process according to claim 16 wherein said LHSV ranges from about 0.1 $hr.^{-1}$ to about 0.5 $hr.^{-1}$.

18. A process according to claim 17 wherein said LHSV is about 0.25 $hr.^{-1}$.

19. A process according to claim 1 wherein the hydrodenitrification catalyst is a sulfided catalyst comprising nickel and molybdenum on an alumina support and said hydrodenitrification process is carried out at a temperature of about 725° F., a pressure of about 2000 psig and an LHSV of about 0.25 $hr.^{-1}$; and said catalyst having hydrogenation activity comprises palladium on a siliceous support and said hydrogenation is carried out at a temperature of about 400° F. and an LHSV of about 0.25 $hr.^{-1}$.

* * * * *